US005875944A

United States Patent [19]

Beletsky

[11] Patent Number: 5,875,944

[45] Date of Patent: Mar. 2, 1999

[54] PADDLE HOLSTERS FOR HANDGUNS AND OTHER WAISTBAND CARRIED OBJECTS

[75] Inventor: Robert J. Beletsky, Temecula, Calif.

[73] Assignee: Bianchi International, Temecula, Calif.

[21] Appl. No.: 815,267

[22] Filed: Mar. 10, 1997

Related U.S. Application Data

[60] Provisional application No. 60/013,150 Mar. 11, 1996.

[51] Int. Cl.[6] ..... F41C 33/02

[52] U.S. Cl. ..... 224/198; 224/911

[58] Field of Search ..... 224/198, 197, 224/911, 912, 926, 482; 108/46

[56] References Cited

U.S. PATENT DOCUMENTS 5,265,781 11/1993 Nochols ..... 224/198
5,285,938 2/1994 Fauchald ..... 224/482
5,372,288 12/1994 Rogers et al. ..... 224/198
5,421,497 6/1995 Gilmore ..... 224/198
5,544,794 8/1996 Nochols ..... 224/198 X
5,641,102 6/1997 Hellweg ..... 224/198

*Primary Examiner*—Renee S. Luebke
*Attorney, Agent, or Firm*—Wagner Middlebrook & Kimbell

[57] ABSTRACT

A paddle type holster including a holster body formed to provide a pouch for holding a handgun or other object and an inside the waistband formed holster support structure. The support structure is in the form of a curved broad surface which generally conforms to the human waist shape and includes a connector portion which extends between the curved portion of the support structure and the holster body. The holster body is rotatably adjustable with respect to the curved portion. The connector portion is likewise vertically adjustable with respect to the holster body to further control the relationship of the support structure. The adjustments are secured by fasteners and by mechanical interlocking of the parts of the holster. A holster or pouch for tall objects is disclosed with a "Z" shaped paddle member.

20 Claims, 5 Drawing Sheets

FIG. 4
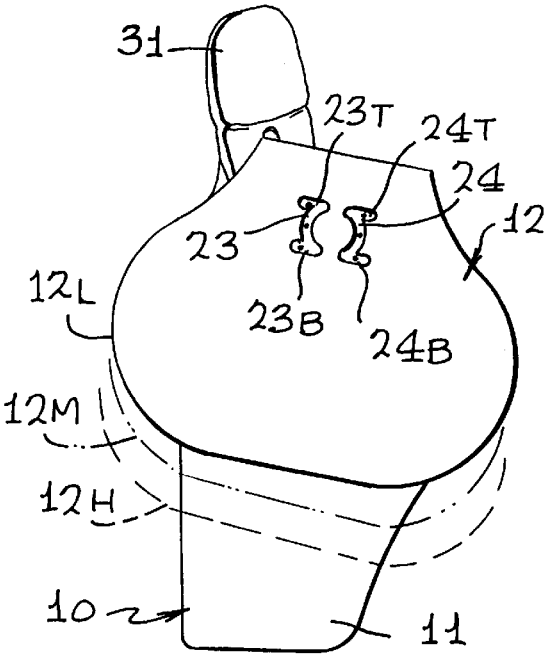
FIG. 5
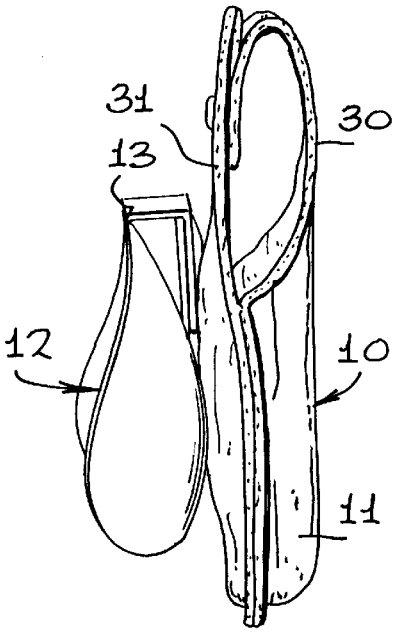
FIG. 6
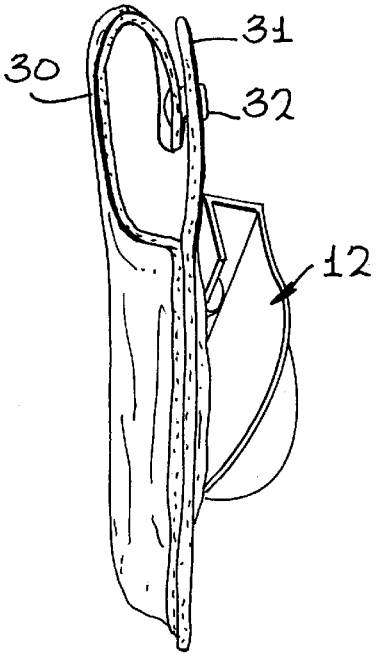
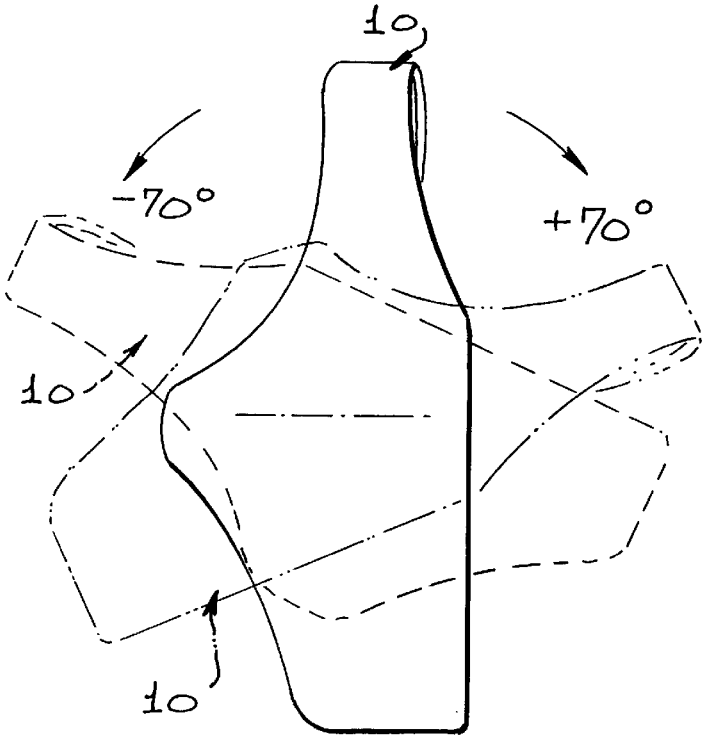
FIG. 9A

FIG. 7
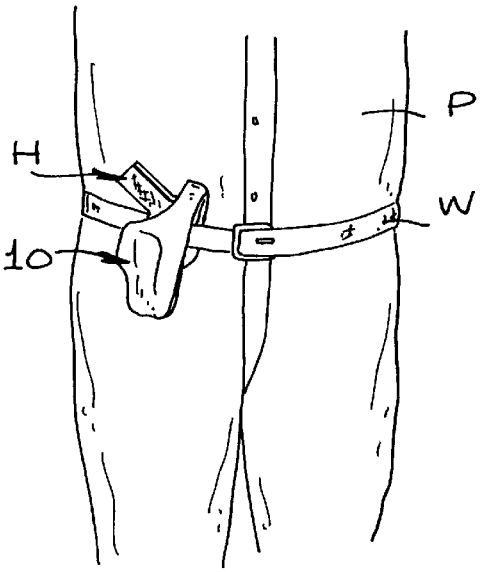
FIG. 8
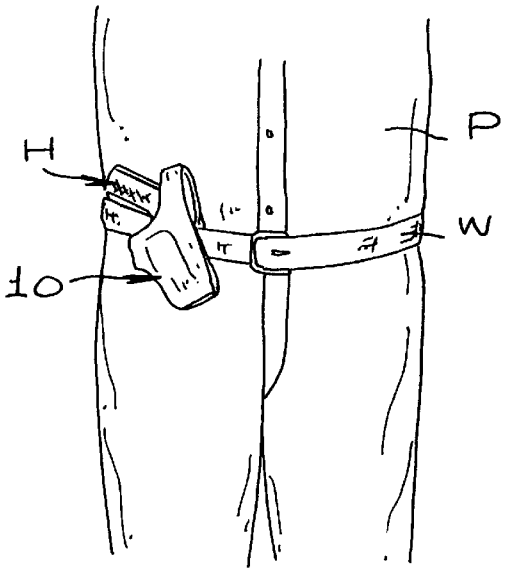
FIG. 18
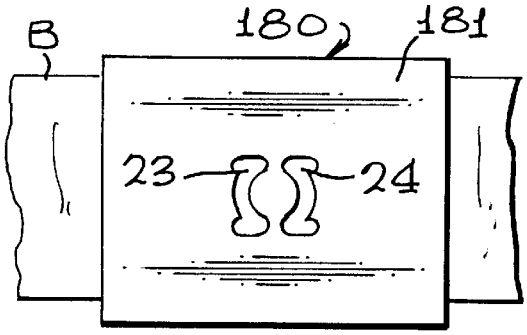
FIG. 9
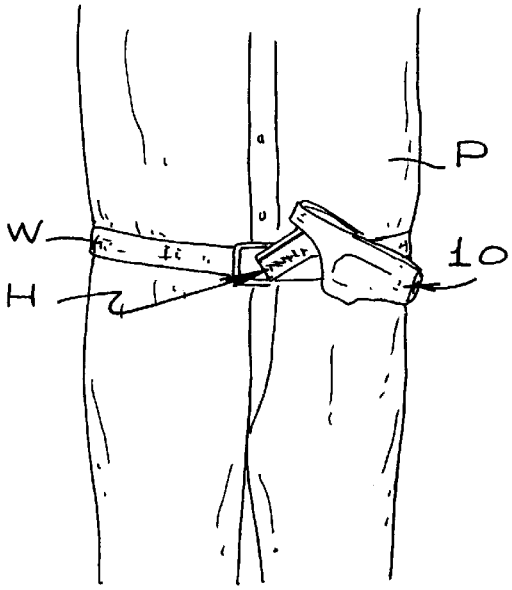
FIG. 20
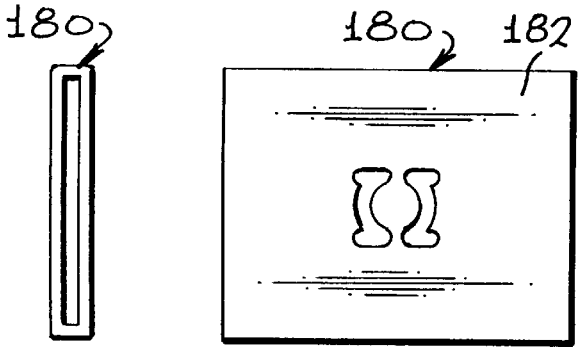
FIG. 19

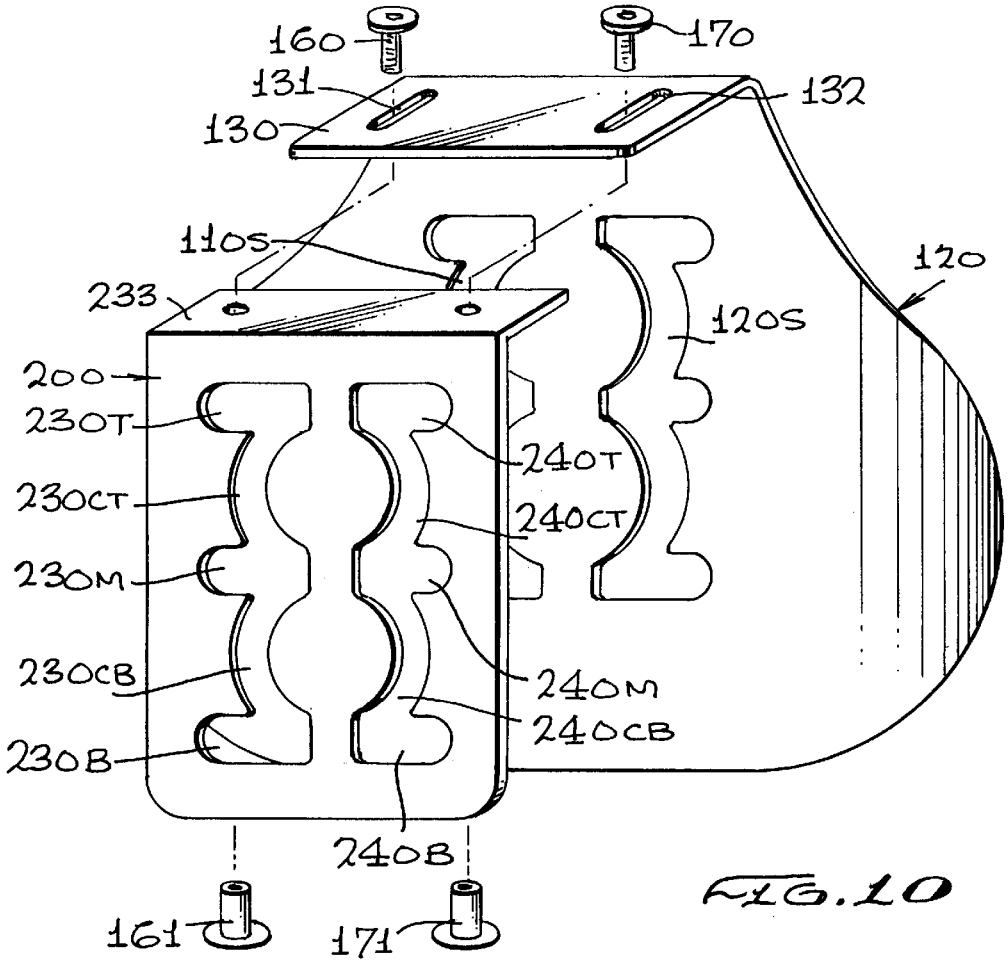
FIG. 10
FIG. 11
FIG. 13
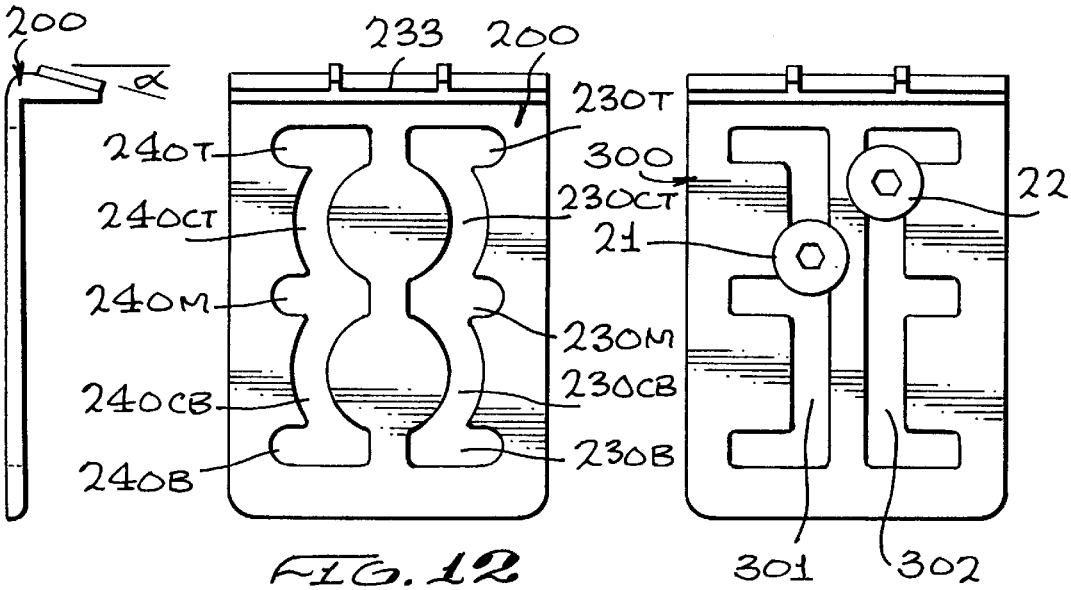
FIG. 12

PADDLE HOLSTERS FOR HANDGUNS AND OTHER WAISTBAND CARRIED OBJECTS

REFERENCE TO RELATED APPLICATION

This application is a non provisional application based upon and claiming benifit of U.S. Provisional Application No. 60/013,150 filed Mar. 11, 1996.

BACKGROUND OF THE INVENTION

A paddle type holster is known as a waistband worn holster which does not require attachment to the wearer's belt and, in fact, may be worn on garments such as trousers or slacks without a belt. The holster can lie close to the wearer's body or away from it and is maintained in place by a curved "paddle" of thin leather or plastic generally pear shaped which lies between the wearer and their trousers on either left or right hip. This is the support portion of the holster. A connector portion is secured to the top of the support portion and rests on the top of the wearer's waistband. The holster also includes a depending or descending portion connected to the inner face of a holster body which is configured to receive a handgun through a top opening. The support portion, the connector portion and the holster body define an inverted "U" shape hooked over the waistband of the wearer or in certain cases described below, in a "Z" shape.

In conventional paddle holsters, the position, height and angle of the holster is primarily established by the wearer's waistband. That may be acceptable but usually is not optimum.

BRIEF DESCRIPTION OF THE INVENTION

In this invention, the support portion of the holster is both rotatably and vertically adjustable with respect to the holster body to allow the wearer to change the cant angle, forward or rearward of the wearer's hip via the rotatable adjustment feature. The vertical adjustment allows the wearer to select high, mid or low range height adjustment of the holster with respect to the wearer's waistband. A degree of front and rear adjustment is also available through this invention.

Additionally, employing an adjustment of the length of the connector portion allows a change in the spacing of the holster body from the wearer and also allows the outward and inward cant of the handgun grip relative to the wearer's hip.

The basic adjustment mechanism of this invention constitutes a pair of overlying plates, one on the holster body and the other on the depending or descending or offset leg of the connecting portion of the holster. The holster body, preferably, includes a pair of captured nuts which define the ends of a diameter of an adjustment circle of rotation and also define a limit of forward or reverse adjustment.

The depending or descending or offset portion of the connector portion includes a pair of vertically oriented side by side dumbbell or "I" shaped slots which define the limits of adjustment. The body or intermediate portion of the slots actually define a partial circle with center at the midpoint between the slots to provide the arc of rotational adjustment of the holster body. The support portion includes comparable openings to allow an adjusting tool such as an allen wrench or screw driver to reach through the support portion and reach fasteners such as pan head screws which engage the captured nuts. Pan head screws with the heads approximately double the size of the slots in the depending or descending portion allows a firm securement of the holster after adjustment.

I have found that the adjustment mechanism of this invention is also usable with the slotted portion of the holster or pouch extending upward rather than downward as the central portion of a "Z" shaped paddle assembly for long objects such as a long barreled handgun or radio in a pouch. Also, the slots may be placed in a belt loop to provide vertical and rotatable adjustment of a holster for a conventional belt loop wearer.

BRIEF DESCRIPTION OF THE DRAWING

This invention may be more clearly understood by reference to the following detailed description and by reference to the drawings in which:

FIG. 4 is an inside view of the holster of FIG. 2, including dashed lines illustrating three different height adjustments;

FIG. 5 is a front elevational view of the holster of FIG. 2;

FIG. 6 is a rear elevational view of the holster of FIG. 2;

FIG. 7 is a fragmentary perspective view of a person wearing the holster of FIG. 2 adjusted to a low ride forward cant position;

FIG. 8 is a fragmentary perspective view similar to FIG. 7 with the holster adjusted to a mid ride, rear canted position;

FIG. 9 is a fragmentary perspective view similar to FIG. 7 with the holster worn in a cross draw position;

FIG. 9A is an outside elevational view of the holster of FIGS. 7–9 showing the angular degrees of rotation possible with this invention;

FIG. 10 is a perspective view of an alternate form of paddle assembly with greater vertical adjustment capability plus body spacing capability;

FIG. 11 is a side elevational view of the depending or descending attachment portion of FIG. 10;

FIG. 12 is an outside elevational view of the depending or descending attachment portion of FIGS. 10 and 11;

FIG. 13 is an outside elevational view of an alternate embodiment of the depending or descending attachment portion of FIGS. 10–12;

FIG. 18 is an outside elevational view of a belt loop incorporating this invention;

FIG. 19 is an end elevational view of the belt loop of FIG. 18; and

FIG. 20 is a rear elevational view of the belt loop of FIG. 18.

DETAILED DESCRIPTION OF THE INVENTION

Figure 1:
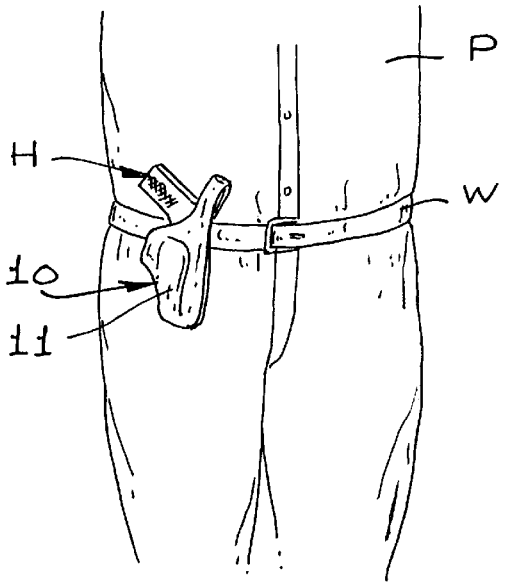
FIG. 1 is a perspective view of a person wearing a paddle type holster on his waistband in a low ride, no cant position.
Figure 3:
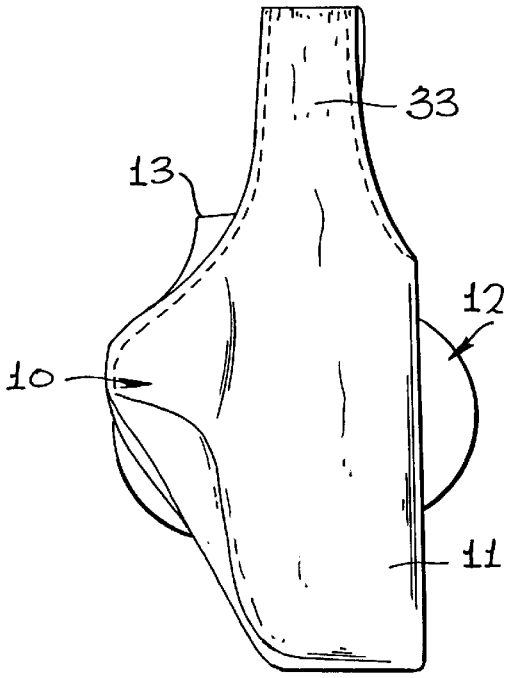
FIG. 3 is an outside view of the holster of FIG. 2.
Figure 2:
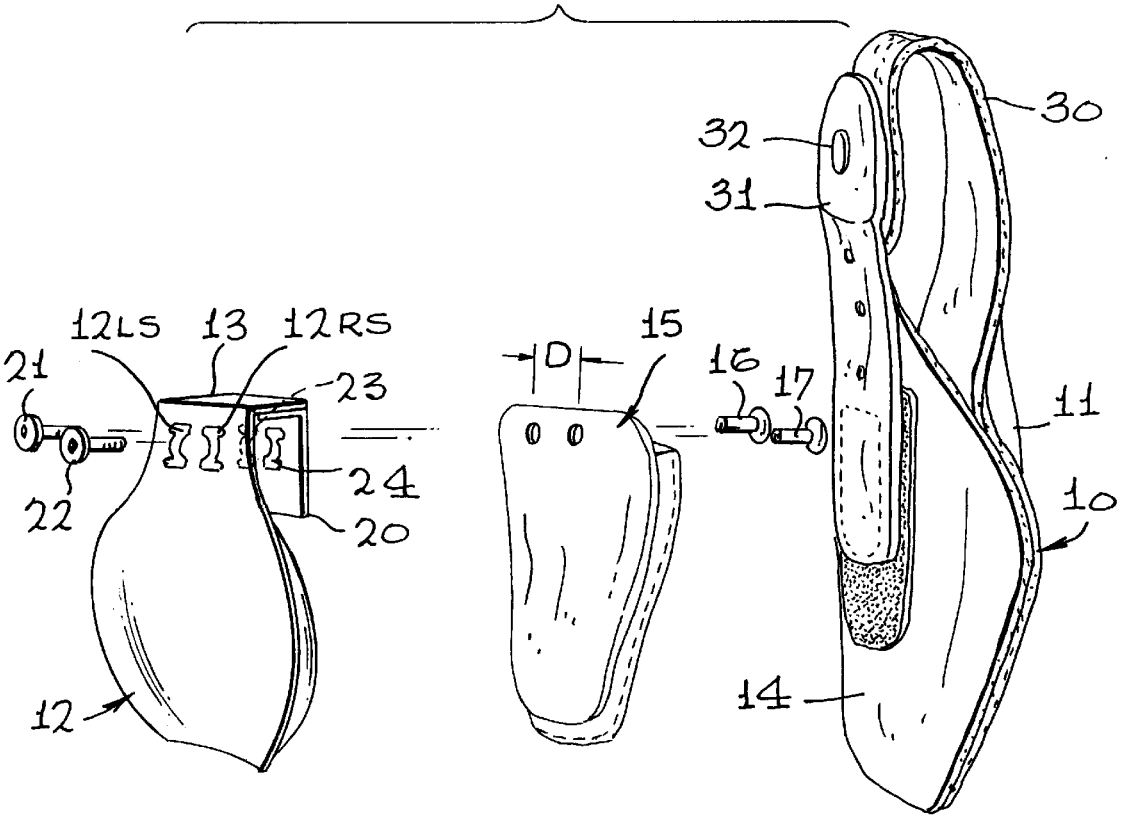
FIG. 2 is an exploded perspective view of the preferred embodiment of this invention.
Figure 14:
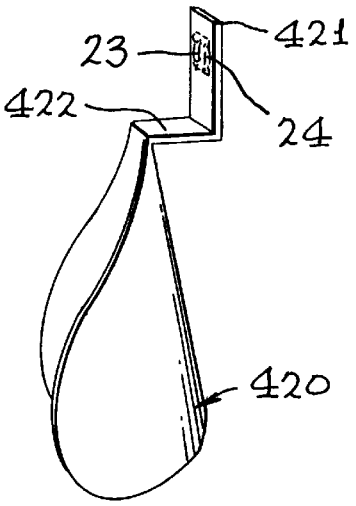
FIG. 14 is a perspective view of an alternate form of paddle.

Now referring to FIG. 1 in combination with FIGS. 2 and 3, a paddle type holster 10 is shown on a person P wearing trousers with a waistband W. Normally the holster 10 and its handgun H are concealed by a jacket but are shown here without a jacket for ease of understanding of the invention. The holster 10 includes a body 11 which forms a pouch for carrying a handgun H. The holster body 11 is supported by a paddle 12 or support portion 12 which is unshown in FIG. 1 but visible in FIGS. 2–6 since it lies against the wearer's hip inside of the waistband W. The paddle 12 is joined to the holster body 11 by means of a connector portion 13, a narrow bridge portion, which lies over the top edge of the waistband W and prevents the holster from slipping downward when worn. In the most common application of this invention, the connector portion 13 is the base of an inverted "U".

In the case of the holster 10 being designed to carry a large pistol or act as a carrier for a large object such as a radio transceiver as shown in FIGS. 14–17, the paddle 12 and holster body 11 form a modified "Z" shape with the connector portion as the intermediate leg of the "Z".

Referring again to FIG. 2, the inner face 14 of the holster 10 carries an adapter plate 15 which may be of plastic and sewn to the inner face 14 of the holster 10. The adapter plate 15 has a pair of captive nuts 16 and 17 located generally toward the top of the plate 15 and spaced at a distance D apart. This distance D defines the area of rotation of the holster body 11 with respect to the paddle 12.

The paddle 12, in addition to the connector portion 13 lying over the wearer's waistband W, also includes a depending or descending portion 20 which is secured to the holster body 11 by fasteners such as pan head screws 21 and 22 which engage captive nuts 16 and 17, respectively.

The depending or descending portion 20 includes a unique pattern of two slots 23 and 24 which may be said to have a modified dumbbell shape or a modified Greek letter sigma Σ shape (with slot 23 a mirror image of the sigma Σ). These slots 23 and 24 are sized to receive the threaded shank of the fasteners 21 and 22 and are spaced to include the distance D at various locations. The top bars of slots 23 and 24 extend further laterally than D and allow forward and rearward movement of the holster body 11 with respect to the paddle 12 when the fasteners 21 and 22 are loosened. The large pan heads of the fasteners 21 and 22 when tightened into captive nuts 16 and 17 overly the edges of the slots 23 and 24 in order to secure the paddle 12 to the holster body 11 in any position selected by the wearer.

A strap 30 integral with body 11 and a thumb break 31 complete the holster. The external appearance of holster 10 is shown in FIG. 3. The thumbbreak may include hook and pile fabric fastener on its inner face at the lower end to mate with corresponding hook and pile fabric on the holster body. This allows the thumbbreak to be adjustable in length and angle on the inner face of the body 11.

The three vertical positions possible in the embodiment of FIGS. 1 and 2 are illustrated in FIG. 4. The upper two dots in slots 23T and 24T at the highest position of screws 21 and 22 show the high ride position for holster body 11. The intermediate ride position is shown by the dots in the center of the curved slot portions 23C and 24C and the bottom dots denote the lowest position of the holster body 11 when the fasteners 21 and 22 are secured at the bottom straight slot portions 23B and 24B. The corresponding positions of the paddle 12 are shown as dashed lines 12M and 12H compared to the present position 12L.

FIGS. 5 and 6 show the front and rear views of holster 10 and are shown in the low ride position of FIG. 4.

In addition to the vertical adjustments available employing this invention, angular adjustments are possible at any of the three heights by loosening screws 21 and 22 and moving the paddle 12 to a position where one or both of the screws are located in the circular portions 23C and 24C, then rotating the paddle 12 to the desired angle and tightening the screws 21 and 22. The range of angular adjustment from a vertical O degree position, in one embodiment is approximately ±70 degrees.

The effect of angular adjustment is demonstrated in FIGS. 7–9 which show three different common positions for wearing a handgun, namely low ride, forward cant (FIG. 7); midride rear cant (FIG. 8); and crossdraw (FIG. 9). The range of angular adjustment of ±70 degrees from the vertical is illustrated in FIG. 9A.

Even greater adjustment is possible employing the embodiment of FIGS. 10–12. First, the spacing of the holster body 11 from the wearer is adjustable by reason of the fact that the depending or descending portion 200 is separable from the paddle portion 120 and has additional captive nuts 161 and 171 which mate with fasteners 160 and 170 after the fasteners pass through slots 131 and 132 in ledge 130 and holes in the depending or descending portion 200. The adjustment of approximately ¾ inch is particularly valuable when the holster is worn by a female plain clothes officer owing to the difference in male and female hip structure. Either ledge 130 or its mating connector portion 233 are at slightly an acute angle alpha α of 5 to 10 degrees as illustrated in FIG. 11.

The embodiment of FIGS. 10–12 also expands the vertical adjustability by the presence of a second interconnecting slot array 230 and 240 having two arcuate sections, a top circular section 230CT and a bottom circular section 230CB and the second slot 240 with its top and bottom circular sections 240CT and 240CB. The slots 230 and 240 also include top linear slot sections 230T and 240T, middle linear slots 230M and 240M and lower linear slots 230B and 240B.

In each of these embodiments described above, the paddles 12 and 120 include matching slots 12LS and 12RS in paddle 12 and slots 110S and 120S in paddle 120. The purpose of these slots in the paddles 12 and 120 is to allow a tool such as a hex or allen wrench to reach through the paddle 12 or 120 and to loosen and tighten the fastener and 160, 170 21 and 22 of FIGS. 1–4 of FIGS. 10–12 to adjust the cant angle and fasteners 21 and 22 of FIG. 13 to adjust the height of the holster body 11.

In my experimentation with this multi-adjustable paddle holster, I have also made two additional discoveries. The first is that the intermediate section need not be circular. As shown in FIG. 13, two back to back "E" configuration slots 301 and 302 in a depending or descending portion 300 will serve to provide vertical and rotational adjustment to any position in which the paddle 12 is adjusted with one fastener 21 in one slot 301 and the second fastener 22 in slot 302. As long as slot portions are spaced at the distance D of FIG. 2, apart, the adjustment and a secured position is possible. A typical rotated position of fasteners 21 and 22 is illustrated in FIGS. 13.

Figure 15:
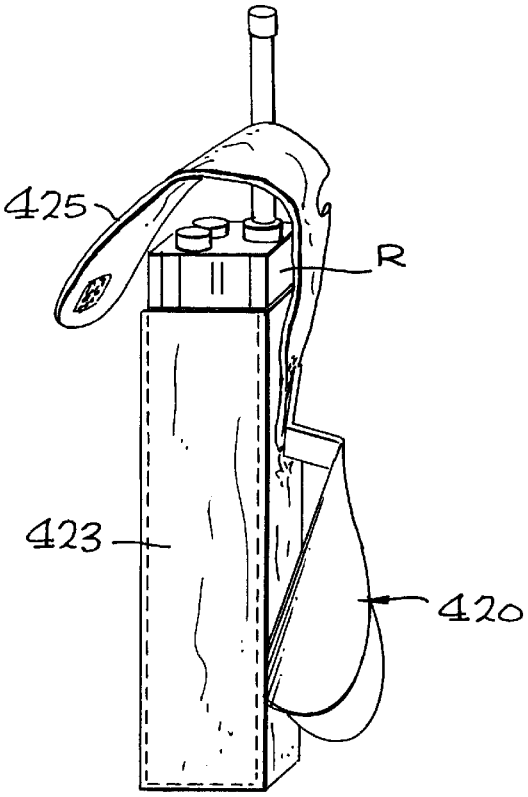
FIG. 15 is a perspective view of a radio pouch or holster incorporating the embodiment of FIG. 14 of this invention.
Figure 16:
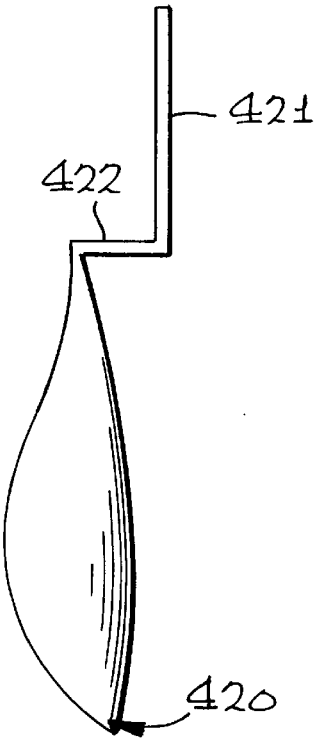
FIG. 16 is a side elevational view of the paddle of FIGS. 14 and 15.
Figure 17:
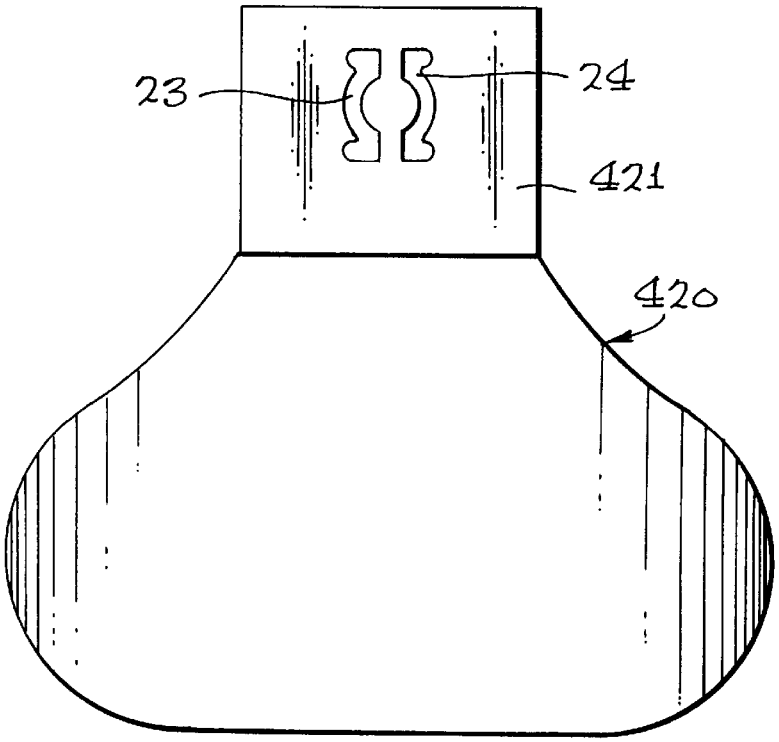
FIG. 17 is an outside elevational view of the paddle of FIGS. 14–16.

The second discovery which I made is illustrated in FIGS. 14–17. I recognized that other carriers than handgun holsters can also benefit from the adjustment features. FIGS. 14–17 illustrate an alternate form of paddle 420 in which the formerly depending or descending attachment portion now is replaced by an upwardly extending plate 421 attached to the paddle 420 and by interconnecting portion 422. The plate 421 includes slots 23 and 24 as best seen in FIG. 17 or may employ the slot form 230 and 240 of FIGS. 10–12 or slots 301 and 302 of FIG. 13. The interconnecting portion 422 rests on the wearer's waistband W as in previous embodiments. In this case, the paddle 420, plate 421 and interconnecting portion 422 define a generally "Z" shape as best seen in FIG. 16 rather than the "U" shape of the previous embodiments. In the embodiment of FIG. 15, the holster body 423 is a rectangular pouch which generally conforms to the shape of the article carried generally. In this case, the article is a radio transceiver R.

A thumb break strap or flap or other type of retainer may be used in this embodiment. As shown in FIG. 15, a flap 425 is illustrated as an example.

Carrying this invention a step further, this invention may be adapted to any type of carrier support, for example, a belt loop carried holster or pouch. FIGS. 18–20 show such a belt loop 180 of FIG. 18 on a belt B with two slots 23 and 24 appearing on both the face 181 and rear side 182 of FIG. 20. Any holster or pouch with fastener parts such as captive nuts 16 and 17 mounted on any holster body may be mounted, adjusted and carried on the belt B. This adjustment mechanism allows full adjustability as described above to any such holster or pouch.

The above described embodiments of the present invention are merely descriptive of its principles and are not to be considered limiting. The scope of the present invention instead shall be determined from the scope of the following claims including their equivalents.

What is claimed is:

1. A paddle type holster adapted to be worn inside of a wearer's trousers having a waistband comprising:

a holster body defining a pouch for the carrying of a handgun;

a paddle adapted to be worn inside of said waistband said holster including an interconnecting portion for connecting the holster body to said paddle;

said interconnecting portion including an offset portion adjacent to the outer surface of said holster body;

said offset portion including a pair of slots therein, each of said slots including curvilinear portions joining linear portions; and means securing said holster body to said offset portion at said slots;

whereby said holster body is adjustable different heights with respect to the wearer's waistband and angularly with respect to said offset portion at said curvilinear slot portions.

2. A paddle type holster in accordance with claim 1 wherein said slot curvilinear portions of said descending offset portion defines a pair of curved slots which generally define a partial circle;

said linear portions of said slots extend generally horizontally when the holster is worn; and said securing means comprising a pair of fasteners extending through said slot curvilinear portions and engaging said holster body for securing the holster body to said offset means.

3. A paddle holster for use by a wearer who wears a garment having a waistband comprising:

a holster body defining a pouch for holding a handgun;

a paddle for location within said waistband;

interconnecting means connecting said paddle to said holster body by extending over the top of said waistband;

offset means secured to said interconnecting means and to said holster body;

said offset means defining a pair of vertically arcuate slots with laterally extending linear slot extensions; and fastener means securing said offset means to said holster body through said slots for angularly, vertically and laterally adjusting the position of said holster body with respect to said offset means.

4. A paddle holster in accordance with claim 3 wherein said holster body includes a pair of fastener receiving means secured thereto on the side of the holster body adjacent to said offset portion;

said fastener receiving means being spaced apart by a predetermined distance;

said offset portion including a pair of slots being arcuate in form and together forming an interrupted circle of diameter corresponding to said predetermined distance; and fastening means extending through said slots and securable to said offset portion at different degrees of angular rotation;

whereby said holster body may be rotated to different cant angles with respect to said offset portion and the wearer's waistband.

5. A paddle holster in accordance with claim 3 wherein said interconnecting means of said paddle holster comprises adjustable overlapping flanges whereby the spacing of said holster body from said paddle is changeable by the wearer.

6. A paddle holster in accordance with claim 5 wherein said interconnecting means comprises overlapping portions of said paddle and said offset means wherein one of said overlapping portions includes at least a slot therein and fastener means adjustably engaging said overlapping portions throughout the length of said slot.

7. A paddle holster in accordance with claim 6 wherein said fastener means comprises at least one screw and one captive nut with the body of the screw extending through the slot in one of said overlapping portions and engaging the captive nut secured to the other of said overlapping portions.

8. A paddle holster for use by a wearer who wears a garment having a waistband comprising:

a holster body defining a pouch for holding a handgun;

a paddle for location within said waistband;

interconnecting means connecting said paddle to said holster body extending over the top of said waistband;

offset means secured to said interconnecting means and to said holster body;

fastening means for angularly and laterally adjusting the position of said holster body with respect to said offset means;

wherein said fastening means includes a pair of spaced fasteners engaging said holster body and adjustably engaging said offset means and a pair of slots in said offset means spaced a distance apart equal to the spacing of said pair of fasteners and said slots each including a curvilinear portion for angular adjustment and a laterally extending slot portion for lateral adjustment of said holster body with respect to said offset means.

9. In an adjustable holster carrier for use with a holster having a body defining a handgun carrying pouch and having a side wall to be worn toward a wearer's body including a pair of spaced fastening means secured to said side wall, the improvement comprising:

a belt loop having an outer face and an inner face and a belt receiving slot therethrough;

the outer face of said belt loop including a pair of slots defining a partial circle with a diameter thereof substantially matching the spacing of the spaced fastening means of a holster carrier body to be attached to said belt loop;

fastening means extendable through said slots and into engagement with said fastening means to secure the carrier body to said belt loop at various angles within the limits of the partial circle of said slots;

wherein the outer face of said belt loop includes generally linear slots joining said partial circular slots whereby a carrier body may be adjusted by said fastening means linearly as well as angularly with respect to said belt loop.

10. In a paddle holster for use by a wearer wearing trousers including a waistband;

a holster body defining a pouch for carrying a handgun and including an outer face and an inner face, the inner face worn near the body of the wearer;

a paddle designed to be worn inside said waist band; and a portion interconnecting the paddle to the holster body;

the improvement wherein the interconnecting portion includes an offset portion securable to the inner face of the holster body including adjusting means adjustable in cant angle and lateral position at different heights with respect to the distances below the wearer's waistband to vary the vertical position to the holster body on the wearer, said adjusting means comprising a pair of arcuate slots extending generally parallel to the holster body and each joined at each end thereof by laterally extending generally linear slots; and further including fastener means extending through each of said pair of slots for securing the holster body to the paddle at selected cant angles and lateral and vertical positions selected by the wearer.

11. A paddle holster for use by a wearer who wears the paddle inside of his waistband for wear at different heights and different cant angles comprising:

a holster body having an outer side and a waistband side and defining a pouch for holding an article;

a paddle for location within the waistband of a wearer;

interconnecting means connecting said paddle to one side of said holster body by extending over the top of the waistband of a wearer;

offset means secured to said interconnecting means;

fastener means securing said holster body to said offset means for angularly and laterally adjusting said holster body with respect to said offset means;

wherein said fastener means includes a pair of fasteners engaging said holster body and adjustably engaging said offset means;

the adjustable engagement of said fastening means constituting a pair of slots in said offset means spaced a distance apart equal to the spacing of said pair of fasteners and said slots each including a curvilinear portion for angular adjustment and a laterally extending slot portion for lateral adjustment of said holster body with respect to said offset means.

12. A paddle holster in accordance with claim 11 wherein said pairs of slots each comprise a pair of generally vertically aligned partial circular sections joined to provide two different cant angles of different heights of the holster body with respect to said paddle.

13. A paddle holster in accordance with claim 11 wherein the curvilinear portions of said pair of slots define an interrupted circle for angular adjustment over the cant angles subtended by the portions of a circle.

14. A paddle type holster in accordance with claim 11 wherein said holster body includes a pair of fastener receiving means secured thereto on the waistband side of the holster body adjacent to said offset means;

said fastener receiving means being spaced apart by a predetermined distance;

said offset means includes a pair of slots being arcuate in form and forming a partial circle of diameter corresponding to said predetermined distance; and fastening means extending through said slots and securable to said offset means at different degrees of angular rotation;

whereby said holster body may be rotated to different cant angles with respect to said offset means and the wearer's waistband.

15. A paddle holster for use by a wearer who wears the paddle inside of a waistband for wear at different heights and different cant angles comprising:

a holster body having an outer side and a waistband side and defining a pouch for holding an article;

a paddle for location within the waistband of a wearer;

interconnecting means connecting said paddle to one side of said holster body by extending over the top of the waistband of a wearer;

offset means secured to said interconnecting means;

fastener means securing said holster body to said offset means for angularly and laterally adjusting said holster body with respect to said offset means;

wherein said holster body includes a pair of fastener receiving means secured thereto on the waistband side of the holster body adjacent to said offset means;

said fastener receiving means being spaced apart by a predetermined distance;

said offset means including a pair of slots being arcuate in form and forming a partial circle of diameter corresponding to said predetermined distance; and fastening means extending through said slots and securable to said offset means at different degrees of angular rotation including at least two linear slots defined by said offset means and engaging respective partial circular slots to provide linear adjustment of said holster body with respect to said offset means whereby said holster body may be rotated to different cant angles with respect to said offset portion and the wearer's waistband.

16. A paddle holster for use by a wearer who wears the paddle inside of a waistband for wear at different heights and different cant angles comprising:

a holster body having an outer side and a waistband side and defining a pouch for holding an article;

a paddle for location within the waistband of a wearer;

interconnecting means connecting said paddle to one side of said holster body by extending over the top of the waistband of a wearer;

offset means secured to said interconnecting means;

fastener means securing said holster body to said offset means for angularly and laterally adjusting said holster body with respect to said offset means;

wherein said offset means defines arcuate slots and linear slots joining said arcuate slots whereby the fastener means may extend through said linear slots as well as arcuate slots to provide both angular and linear adjustment of said holster body with respect to said paddle.

17. A paddle holster for use by a wearer who wears the paddle inside of a waistband for wear at different heights and different cant angles comprising:

a holster body having an outer side and a waistband side and defining a pouch for holding an article;

a paddle for location within the waistband of a wearer;

interconnecting means connecting said paddle to one side of said holster body by extending over the top of the waistband of a wearer;

offset means secured to said interconnecting means;

fastener means securing said holster body to said offset means for angularly and laterally adjusting said holster body with respect to said offset means;

wherein the angular and lateral adjustment of said fastener means is accomplished by movement in generally Greek letter sigma shaped slots in said offset means.

18. A waist worn article carrier for use by a wearer who carries an article at ones waistband comprising:

an article carrier body defining a pouch for holding an article to be carried;

support means for said carrier at the waistband of a wearer;

interconnecting means connecting said support means to said article carrier body;

offset means secured to said interconnecting means and to said article carrier body; and fastener means for angularly and laterally adjusting the position of said article carrier body with respect to said offset means;

wherein said fastener means includes a pair of spaced fasteners engaging said article carrier body and adjustably engaging said offset means; and the adjustable engagement of said fastening means includes a pair of slots in said offset means spaced a distance apart equal to the spacing of said pair of fasteners and said slots each including a curvilinear portion for angular adjustment and a laterally extending slot portion for lateral adjustment of said article carrier body with respect to said offset means.

19. A waist worn article carrier in accordance with claim 18 wherein the curvilinear portions of said slots define an interrupted circle for angular adjustment over the angles subtended by the curvilinear portions of a circle made up by said slots and for vertical adjustment by communication of said curvilinear portion with said laterally extending slot portions.

20. A waist worn article carrier in accordance with claim 18 wherein said article carrier body includes a pair of fastener receiving means secured thereto on the side of the article carrier body adjacent to said offset portion;

said fastener receiving means being spaced apart by a predetermined distance;

said offset portion including a pair of slots being arcuate in form and together forming an interrupted circle of diameter corresponding to said predetermined distance; and fastening means extending through said slots and securable to said offset portion at different degrees of angular rotation;

whereby said article carrier body may be rotated to different cant angles with respect to said offset portion and the wearer's waistband.

* * * * *